United States Patent [19]

Card et al.

[11] Patent Number: 4,688,497

[45] Date of Patent: Aug. 25, 1987

[54] YARN FEED MECHANISM FOR TUFTING MACHINE

[76] Inventors: Roy T. Card, 4012 Creekwood Ter., Chattanooga, Tenn. 37421; Joseph L. Card, 1515 Heritage Landing Dr., Chattanooga, Tenn. 37405

[21] Appl. No.: 929,439

[22] Filed: Nov. 12, 1986

[51] Int. Cl.[4] ..... D05C 15/18

[52] U.S. Cl. ..... 112/80.73

[58] Field of Search ..... 112/80.73

[56] References Cited

U.S. PATENT DOCUMENTS

| | | | |
|---|---|---|---|
| 2,862,465 | 12/1958 | Card | 112/79 |
| 3,075,482 | 1/1963 | Card | 112/79 |
| 3,103,187 | 9/1963 | Hammel, Jr. | 112/79 R |
| 3,435,787 | 4/1970 | Short | 112/79 |
| 3,489,326 | 11/1970 | Singleton | 226/109 |
| 3,605,660 | 9/1971 | Short | 112/79 A |
| 3,752,094 | 8/1973 | Short | 112/79 A |
| 3,847,098 | 11/1974 | Hammel, Jr. | 112/79 A |
| 4,608,935 | 9/1986 | Bardsley | 112/80.73 |

FOREIGN PATENT DOCUMENTS 1126410 8/1967 United Kingdom .

*Primary Examiner*—Ronald Feldbaum

*Attorney, Agent, or Firm*—Newton, Hopkins & Ormsby

[57] ABSTRACT

A yarn feed mechanism in which a counterlever frame extends forwardly from the tufting machine has high speed and low speed drive shafts driven, in synchronization, with the needle bar. Transversely aligned pairs of yarn feed rolls are suspended from the frame below each shaft and are driven through chains and sprockets from their associated drive shafts when the individual clutches of the rolls are energized. The rolls of transversely aligned pairs of rolls are spaced from each other with no intervening shaft so that intermediate portions of yarns extending between a coil and the rollers can be installed partially around the selected rolls without breaking or removing the yarns from the needles.

10 Claims, 8 Drawing Figures

YARN FEED MECHANISM FOR TUFTING MACHINE

BACKGROUND OF THE INVENTION

This invention relates to tufting machines and is more particularly concened with the yarn feed mechanism for selectively feeding yarns to the needles of the tufting machine.

In the past, numerous yarn feed mechanisms have been devised, in which one of several frames support yarn feed rolls which are selectivily engaged and disengaged with a drive transmission so as selectively to feed the respective yarns to the needles, according to a prescribed pattern. U.S. Pat. No. 3,847,098 is typical of the type of yarn feed mechanism which feeds the yarns through use of rolls. U.S. Pat. No. 2,862,465 disclosed still another type of yarn feed mechanism in which a plurality of yarn feed rolls are individually clutch controlled by a pattern control mechanism so that each of the plurality feed rolls is driven at different speeds, independently of any of the other feed rolls. Each roll is adapted to control the speed of the yarn to a particular row of stitches within a repeat pattern in order to produce a pattern of high and low loops.

U.S. Pat. No. 3,489,326 disclosed still another form of yarn feed mechanism which employs clutch controlled rolls for selectively feeding the yarn to the needles of the tufting machine. In substantially all of the prior art tufting machines which employ clutch controlled rolls, it is necessary to feed an end of the yarn over one roll and under another in order to thread the machine, because of the drive shafts on which the rolls are disposed.

The present invention disposed the rolls in counterlever fashion on the ends of short drive shafts such that access can be had to each roll by an intermediate portion of a single or several strand of yarns. Thus, the yarns can be disposed over one roll and under another, without the necessity of unthreading the yarn or breaking the yarn.

BRIEF SUMMARY OF THE INVENTION

Briefly described, the present invention includes a conventional tufting machine from which protrudes a horizontally disposed support frame. Carried by this support frame are a plurality of parallel drive shafts which extend transversely through the frame, the shafts being journalled at intervals by the frame. These shafts are driven at different speeds but in synchronization with the reciprocation of the needles. Certainly the shafts are driven at relatively high speed and others at relatively low speeds. Disposed below the main frame are a plurality of pairs of yarn feed rolls, each pair being carried by a roll shaft journalled by a roll shaft support bracket secured to the frame. Each pair of the rolls are on opposite sides from the support frame and are mounted at the ends of the roll shaft. On the ends of each shaft and within each roll is an electric clutch, the rolls being selectively engaged and disengaged from the common roll shaft by actuation of the individual clutch for that roll. Each roll shaft is driven from one of the drive shafts.

Each roll has a roughened periphery so as to be capable of driving one or a plurality of yarns at the peripheral speed of the roll.

An important feature of the present invention is the fact that there is an open and unobstructed area between adjacent rolls in each pair of rolls, whereby an operator can grasp intermediate portions of one or a plurality of yarns and loop the intermediate portion or portions over one roll and under another roll which is longitudinally aligned with the first roll. Therefore, there is no need to unthread a needle or break a yarn in order to pass it over one roll and under another. Each high speed roll is between the needle and the low speed roll along the path of the yarn.

Accordingly, it is an object of the present invention to provide a yarn feed mechanism for a tufting machine, the yarn feed mechanism being inexpensive to manufacture, durable in structure and efficient in operation.

Another object of the present invention is to provide a yarn feed mechanism which can be readily and easily installed on a conventional tufting machine with minor modifications to the tufting machine.

Another object of the present invention is to provide a yarn feed mechanism for a tufting machine, the yarn feed mechanism being capable of receiving on rolls, intermediate portions of the yarn so that the yarn can be installed on the yarn feed mechanism, without breaking or unthreading the yarn.

Another object of the present invention is to provide a yarn feed mechanism which is readily accessed by an operator and which, when yarns are broken, can be readily and easily serviced.

Another object of the present invention is to provide a yarn feed mechanism in which to rolls thereof are disposed at a convenient height for access by an operator so that broken yarns can be readily and easily reinstalled on the tufting machine.

Other objects, features and advantages of the present invention will become apparent from the following description when taken in conjunction with the accompanying drawing wherein like characters references designate corresponding parts.

DETAILED DESCRIPTION

Figure 1A:
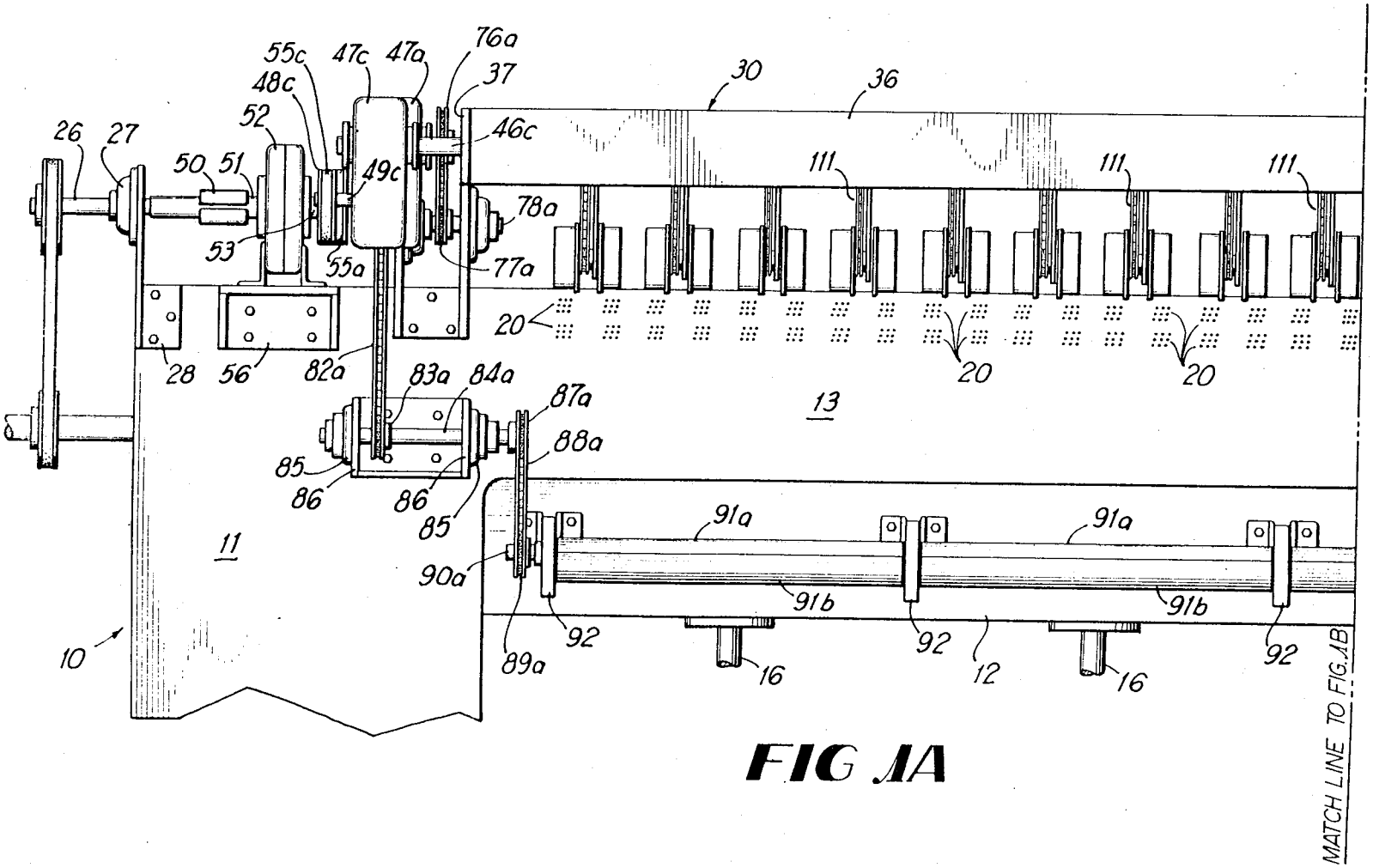
FIG. 1A is a fragmentary front elevational view of the upper left hand portion of a conventional tufting machine, on which is installed a yarn feed mechanism constructed in accordance with the present invention.

Referring now in detail to the embodiment chosen for the purpose of illustrating the present invention, it being understood that in its broader aspects, the present invention is not limited to the exact details herein depicted, numeral 10 in the drawings denotes generally a conventional tufting machine having a transversely extending head 12 which is supported at its end portions by legs 11. It will be understood by those skilled in the art that the looper section and the material backing or base fabric feed rolls, together with the backing material or base fabric itself, which is normally fed across the tufting machine 10 had been deleted for clarity. The head 12 includes a front plate 13, a rear plate 14 and a top plate 15. Push rods 16 protude through the bottom 17 of the head 12 and carry a needle bar 18 which, in turn, is provided with a plurality of transversely aligned needles 19. One or more rows of such needles 19 are conventionally used in a tufting machine. When the needle bar 18 is reciprocated, yarns 10 which are fed to the needles 19 produce piles of yarns in a backing material when the needles 19 insert the yarns through the backing material. The tufting machine 10 thus far described is wholly conventional.

According to the present invention, a yarn feed mechanism, denoted generally by the numeral 30, is mounted in cantilever fashion on the upper front edge portion of the tufting machine 10. This yarn feed mechanism includes a plurality of L-shaped mounting bases which are bolted by bolts 32 to the upper front edge portion of tufting machine 10, one plate of each mounting base 31 extending over a portion of the top plate 15 and the other plate of each base 31 extending over a portion of the front plate 13. The bases 31 are spaced transversely from each other and respectively carry the upwardly and outwardly extending brackets 33 which form the support for the horizontal rectangular frame 34 of the yarn feed mechanism 30.

In more detail, the horizontal frame 34 is an open rectangular member formed of a back rail or beam 35 and a front rail or beam 36 which are disposed in spaced parallel relation to each other, the ends of the rails 35 and 36 being joined by end plates 37 and 38 which are disposed parallel to each other and extend longitudinally with respect to the tufting machine 10. The outer ends of the brackets 33 are provided with mounting plates 40 which are, in turn, secured by bolts 41 to the rail 35.

Within the frame 34, a plurality of transversely equally spaced vertically disposed petitions 42 extend between the front rail 36 and the back rail 35, these petitions 42 being disclosed parallel to each other and parallel to the end plates 37 and 38. The petitions 42 are provided with bearings 43 and the end plates 37 and 38 are provided with bearings 45.

Figure 1B:
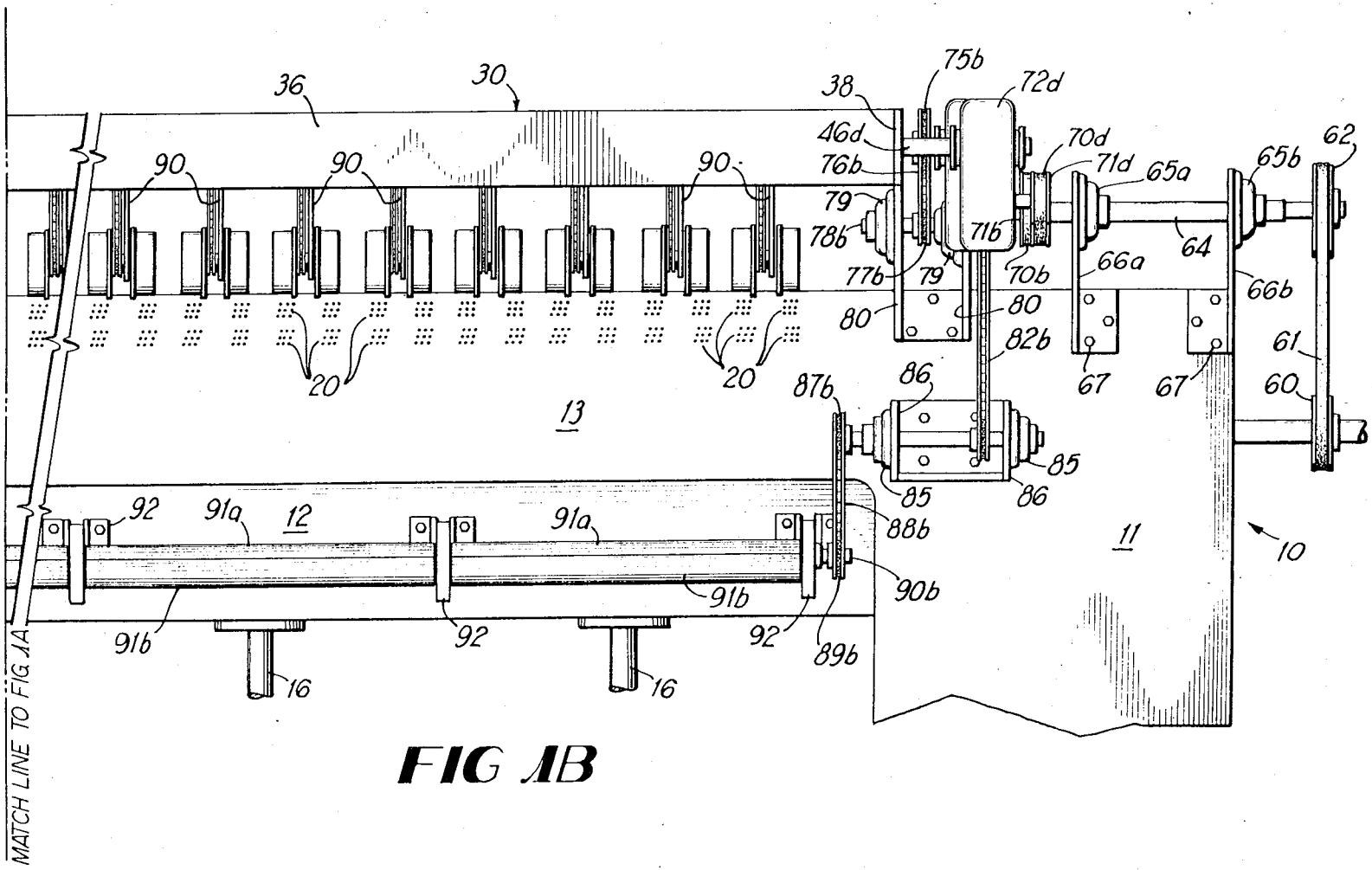
FIG. 1B is a view similar to 1A but showing the right portion of the tufting machine depicted in FIG. 1A and the right portion of the yarn feed mechanism constructed in accordance with the present invention.
Figure 2A:
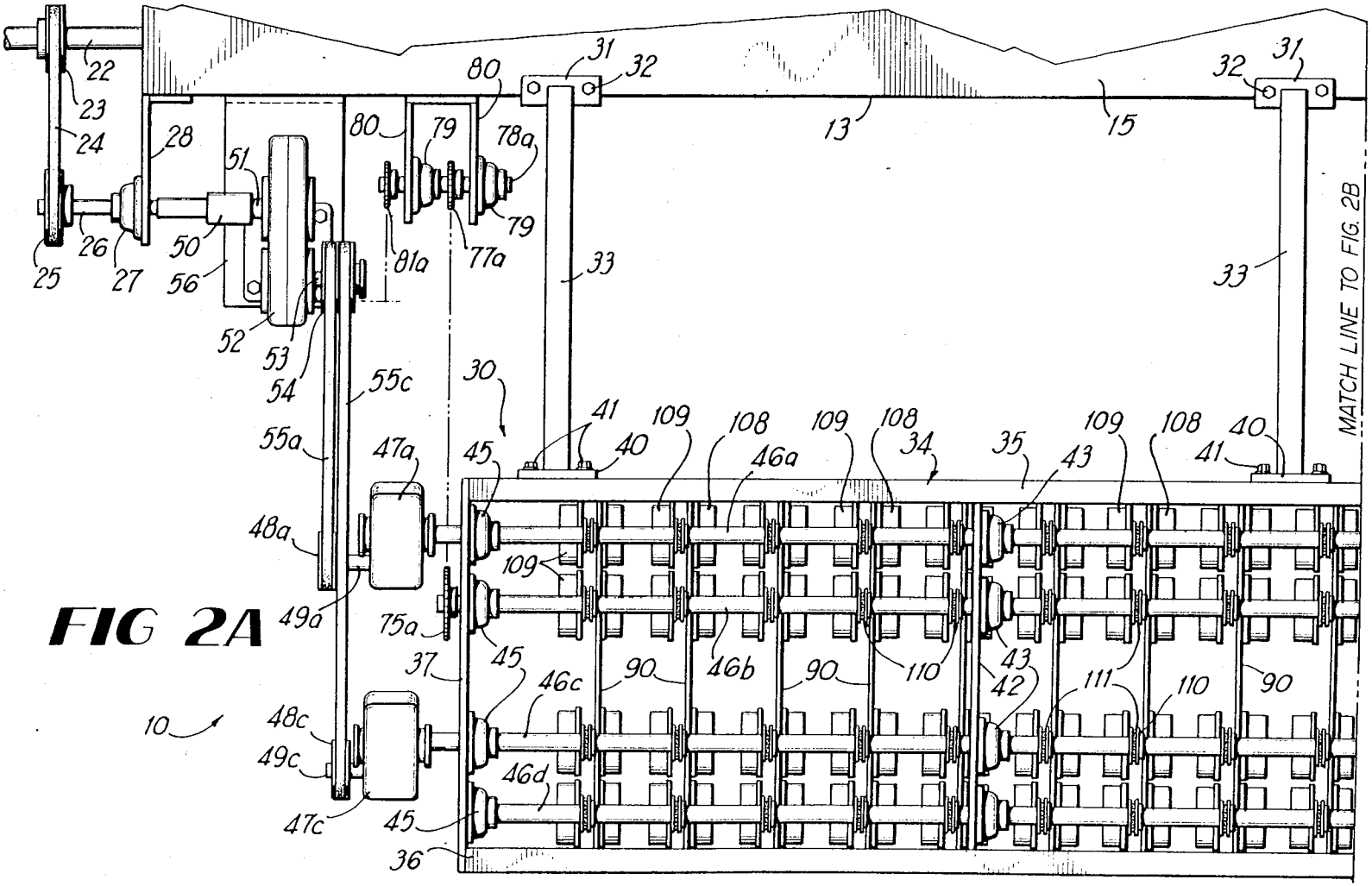
FIG. 2A is a fragmentary top plan view of the left hand front portion of the tufting machine of FIGS. 1A and 1B and the left hand portion of the yarn feed mechanism of the present invention.
Figure 2B:
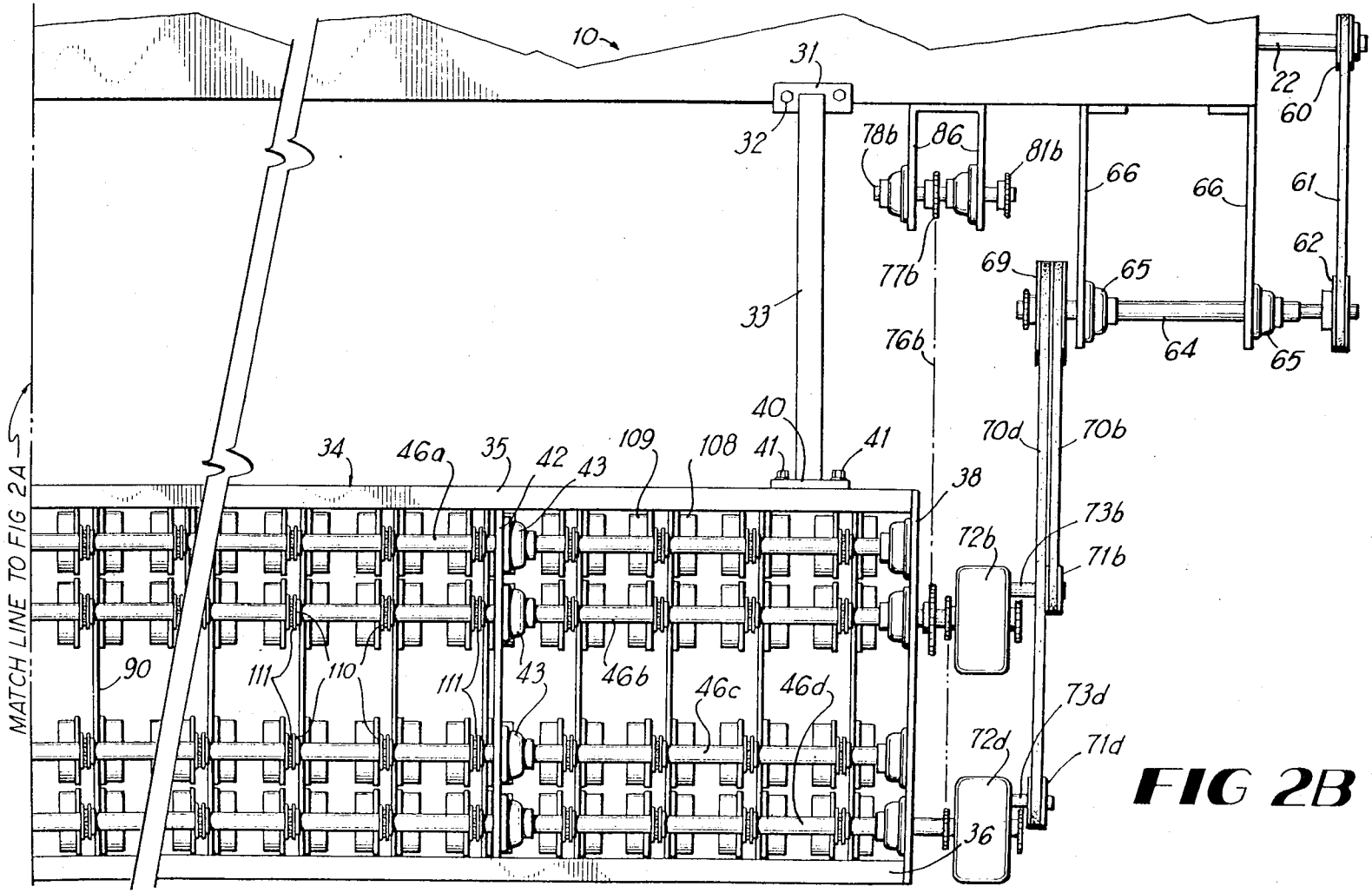
FIG. 2B is a fragmentary top elevational plan view of the right hand portion of the tufting machine and the right hand portion of the yarn feed mechanism constructed in accordance with the present invention.
Figure 3:
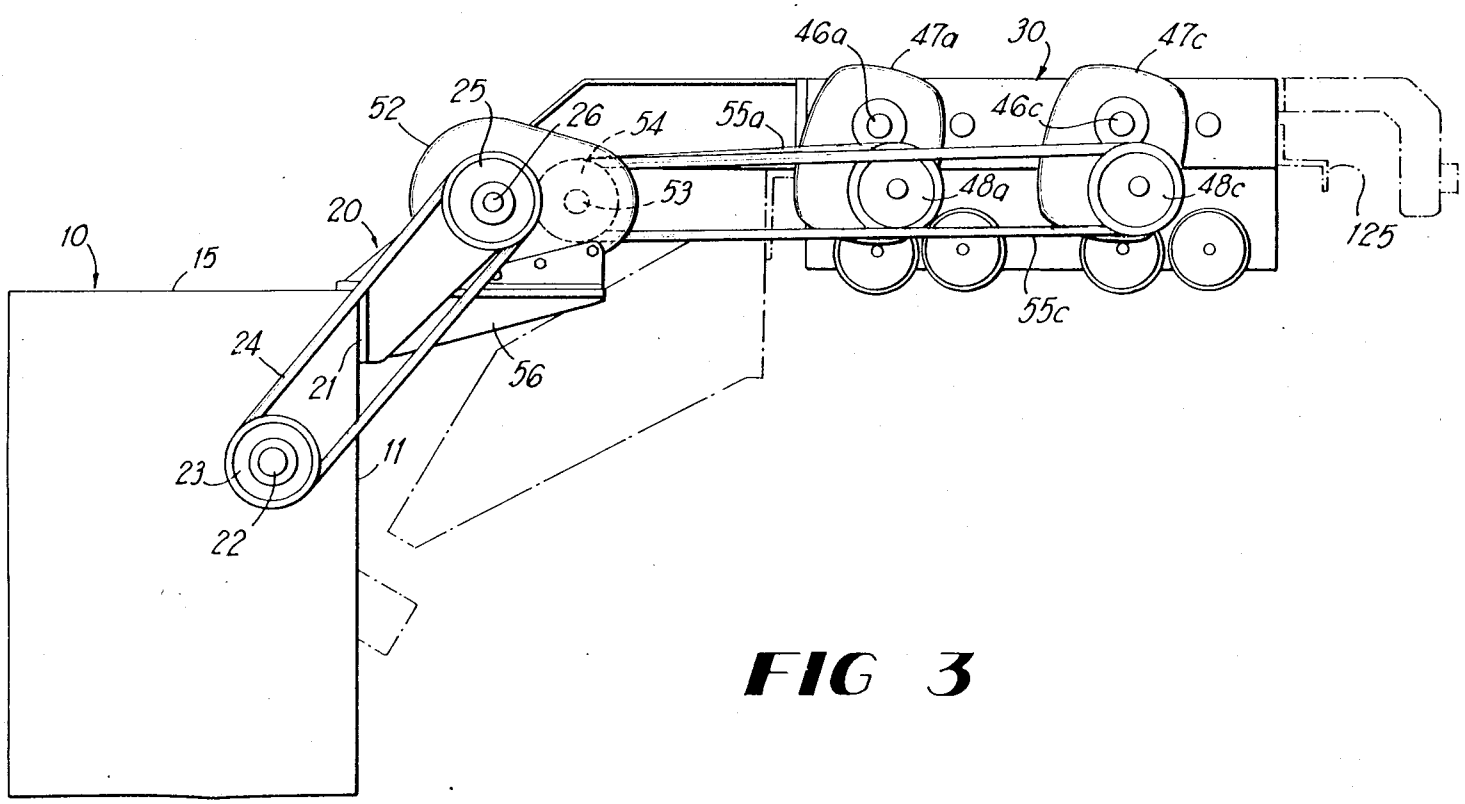
FIG. 3 is a schematic side elevational view of the tufting machine and the yarn feed mechanism depicted in FIGS. 1A and 1B.

The bearings 43 and 45 journal four drive shafts **46*a*, 46*b*, 46*c* and 46*d*, whereby the ends of shafts 45*a* and 45*c* protrude outwardly through the end plate 37 and the ends of the shafts 46*b* and 46*d* protrude through the end plate 38. The shafts 46*a* and 46*c* are the high speed shafts, being respectively provided with gear reducers 47*a* and 47*c*, the input shafts 49*a* and 49*c* of which are driven by pulleys 48*a* and 48*c*. Power for driving the pulleys 46*a* and 46*c* is provided, as shown in FIG. 2A from the main drive shaft 22 of the tufting machine through a power train. This power train includes a pulley, of sheave 23 mounted on the main drive shaft 22, of the tufting machine 10, the pulley 23 driving through belt 24, a pulley 25 on a power transfer shaft 26. The power transfer shaft 26 is journalled by a bearing 27 on bracket 28, carried by the corner portion of the tufting machine 10 as shown in FIGS. 1A and 1B**.

The gear train also includes a coupling 50 connected to the drive shaft 51 of a gear reducer which may be in the form of a variable speed drive 52, the output shaft 53 of which is provided with a two groove sheave 54 which drives belts **55*a* and 55*c* which pass around the sheaves or pulleys 48*a* and 48*c*, respectively. By such an arrangement, the low speed shafts 46*a* and 46*c* are driven at the same speed and in the same direction of rotation and in synchronization with the reciprocation of the needles 19 since the main drive shaft 22 drives the push rods 16**.

The main drive shaft 22 protrudes outwardly from the other end of the tufting machine 10, and is provided, as shown in FIGS. **2*b* and 5 with a sheave or pulley 60 which drives a continuous belt 61, passing over a sheave or pulley 62 mounted on the end of a power transfer shaft 64. The power transfer shaft 64 is journalled by bearings 65 mounted on brackets 66, respectively, the brackets 66 projecting upwardly and forwardly form the upper corner portion of the tufting machine 10. Shaft 64 protrudes inwardly and is provided at its inner end portion with a double groove sheave or pulley 69. Belts 70*b* and 70*d* pass around the sheave 69 and thence, around drive sheaves 71*b* and 71*d* on gear reducers 72*b* and 72*d*. The pulleys 71*b* and 71*d* respectively drive the input shafts 73*b* and 73*d* of the gear reducers 72*b* and 72*d* which rotate shafts 46*b* and 46*d*, so that the low speed drive shafts 46*b* and 46*d* are driven at the same rate of speed and in the same direction, whereby the rotation of the drive shafts 46*b* and 46*d* are synchronized with the rotation of the shaft 22 and, therefore, synchronized with the reciprocation of the needles 19**.

At the ends of shaft **46*b*, outwardly of the end plates 37 and 38, the shaft is provided with sprockets 75*a* and 75*b* which drive continuous chains 76*a* and 76*b*, the chains 76*a* and 76*b* passing respectively around sprockets 77*a* and 77*b* for driving the same. The sprockets 77*a* and 77*b* are respectively mounted on power transfer shafts 78*a* and 78*b*. The power transfer shafts 78*a* and 78*b* are journalled by bearings 79 carried by brackets 80 which project from the tufting machine 10 as shown in FIGS. 1A, 1B, 2C, 2D**.

The shafts **78*a* and 78*b* drive sprockets 81*a*, 81*b*, which, respectively, are provided with continuous chains 82*a* and 82*b*. These chains 81*a*, 81*b*, respectively passing around sprockets 83*a* and 83*b* on shafts 84*a* and 84*b* journalled by bearings 85 on brackets 86 mounted on the front of the tufting machine 10, as illustrated. The shafts 84*a* and 84*b*, drive sprockets 87*a* and 87*b*. Sprockets 87*a* and 87*b* are provided with continuous chains 88*a* and 88*b* which, in turn, drives sprockets 89*a* and 89*b*, respectively. These sprockets, 89*a* and 89*b* are fixed to the drive shafts 90*a* and 90*b* which, drive, from opposite ends, the yarn feeder rolls 91*a* and 91*b* mounted close to the bottom portion of the tufting machine 10 by brackets 92. Rolls 91*a* rotate in an opposite direction from roll 91*b* so as to urge the yarns 20, passed between rolls 91*a*, 91*b*, toward the needles 19**.

Figure 6:
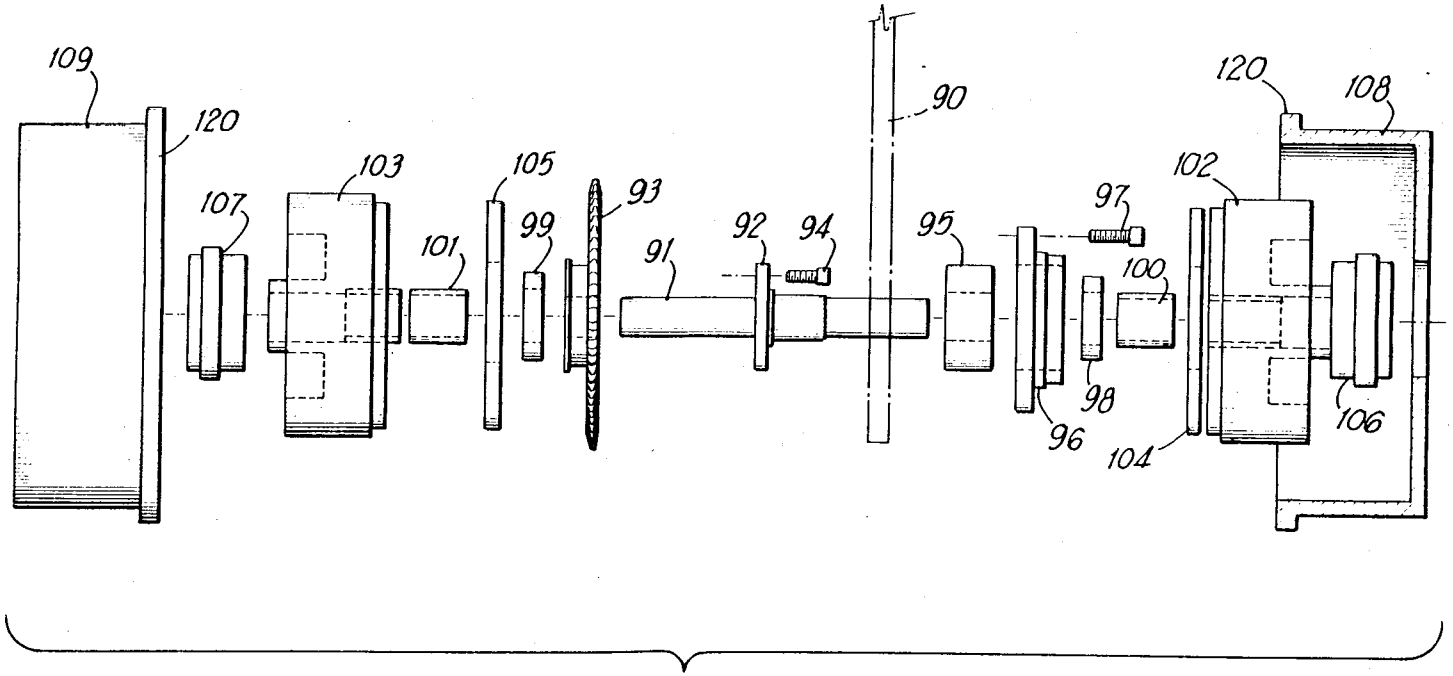
FIG. 6 is a partially broken, enlarged exploded view of a detail of the yarn feed mechanism.

The frame 34, along its bottom portion, is provided with a plurality of equally spaced, parallel, longitudinally extending, vertically disposed support plates 95 which protrude below the lower plane of the frame 34, each support plate 95 being secured by its upper corners, respectively, to the rails 35 and 36. Each support plate 95 is provided with a plurality of transversely extending roller shafts, such as shaft 91, seen in FIG. 6. Each shaft 91 protrudes through an appropriate opening in the plate 90 so that the ends of the shaft protrude on opposite sides of the associated plate 90. The central portion of the shaft 91 is provided with a spindle 92, against which is received a sprocket 93, the sprocket being secured in place on the spindle 92 by means of a bolt 94. The spindle 92, in turn, is received on a bearing 95 housed in a bearing housing 96, the bearing housing being secured to the plate 90 by means of a machine screw 97. Outwardly of the housing 96 is a clutch spline 98 and outwardly of the sprocket 93 is a second clutch spline 99. The clutch splines 98 and 99 are secured to and rotate with the shaft 90 when it is, itself, rotated by the sprocket 93. Roller bearings 100 and 101 are disposed on the shaft 91, protruding into clutches 102 and 103, respectively for permitting rotation of these clutches, except when the clutches are energized, so as to clamp against the clutch plates 104 and 105 which respectively are received on the splines 98 and 99. The outer ends of the clutches 102 and 103 are respectively provided with adapter hubs 106 and 107 which receive thereon the cup shaped rolls 108 and 109, respectively. These clutches 102 and 103 are cylindrical members and the rolls 108 and 109 extend over the peripheries of their respective clutches, being received on the adapters 106 and 107. The clutches 102 and 103 have electrical coils (not shown) which are energized through slip rings (not shown). When these coils are energized, the clutches magnetically engage the clutch plates 104 and 105, respectively and rotate the engaged roll 108 or 109. When the clutch is not engaged, the roll 108 or 109 is free to rotate.

Above each of the sprockets, such as sprocket 93, on the shafts **46*a*, 46*b*, 46*c* and 46*d* are a plurality of axially spaced sprockets 110 which are respectively above each of the sprockets 93. Chains 111 extend downwardly, below the frame 34 and around their associated sprockets, such as sprocket 93. Thus, each shaft 91 is driven continuously from an associated drive shaft 46*a*, 46*b*, 46*c* or 46*d*, as the case may be. Thus, when a clutch such as clutch 102 is electrically energized, that roll will then be rotated at a prescribed high or low rate, as the case may be. As pointed out above, the shafts 46*a* and 46*c* are the high speed shafts and the shafts 46*b* and 46*d*** are the low speed shafts, thus, their associated rolls will be rotated at the high speed or low speed when the associated clutch of that roll is energized.

Since any one of a number of electrical control members can be utilized with the yarn feed mechanism herein disclosed, no particular electrical control is revealed. Suffice it to state that there are individual circuits to each of the clutches, such as clutch 102 and 103 whereby individual control of each roll is achieved. As best seen in FIGS. 1A, 1B, 2A and 2B, a plurality of pairs of rolls 108, 109 are arranged in rows beneath the respective drive shafts **46*a*, 46*b*, 46*c* and 46*d*, there being sufficient space between a roller 109 of one pair and the adjacent roller 108 of the adjacent pair so that the access may be had to each roll for passing an intermediate portion of a yarn or several yarns over the periphery of the roll 108 or 109 as designed. Each roll 108 or 109 is provided with a peripheral sand paper periphery and a peripheral shoulder 120 along its inner portion so that the yarns will be positively fed and the shoulder prevent the yarns from moving inwardly beyond the periphery of roll 108 or 109**.

These low speed shafts 91 and in a first common transverse axis and the high speed shafts are in a second common shafts 91 are transversely spaced from each other. Thus each adjacent roll 108 on one first shaft 91 is spaced from an adjacent roll 109 of the next first shaft 91 to provide an unobstructed access for loading intermediate portions of yarns on the rolls without breaking or enthreading the yarns.

Figure 4:
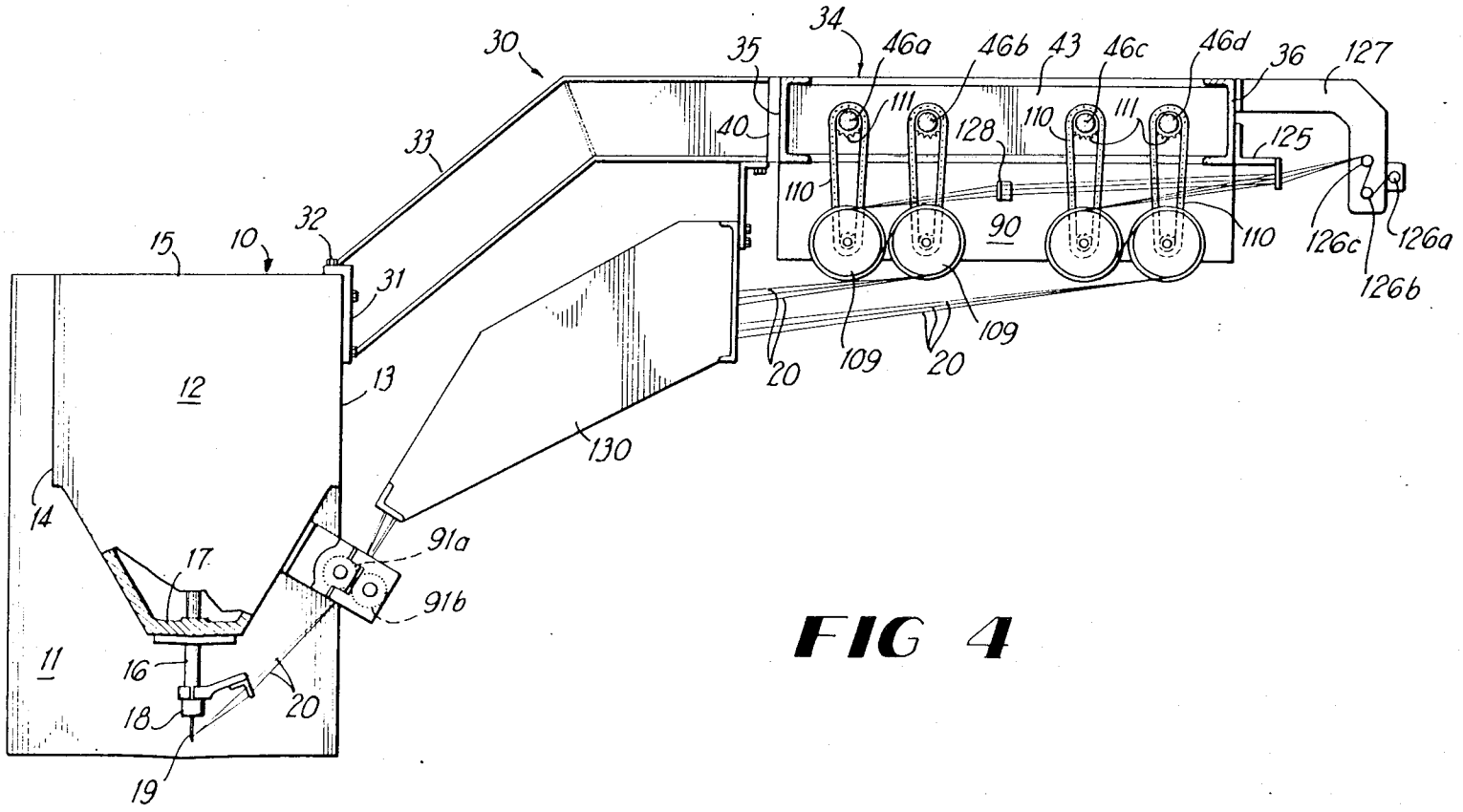
FIG. 4 is a vertical sectional veiw of the tufting machine and yarn feed mechanism of the preceding drawings.
Figure 5:
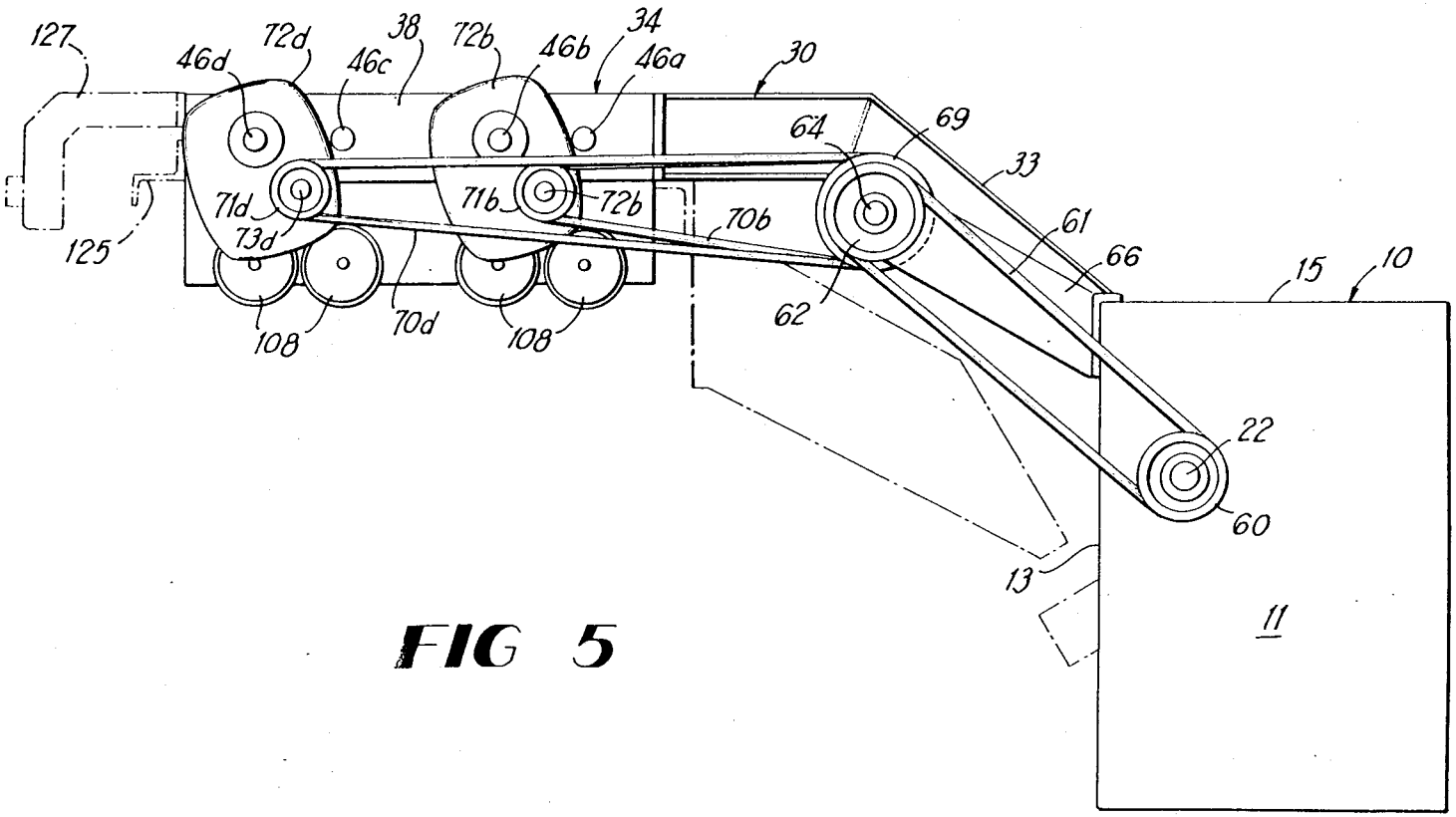
FIG. 5 is a side elevational view of the machine in FIGS. 1A and 1B.

As best seen in FIG. 4, a yarn guide 125 is provided along the outer surface of the rail 36, by being provided a plurality of holes, spaced vertically and horizontally from each other so as to guide the individual yarns 20, fed from a source of yarns, such as a creel (not shown).

Outwardly of the yarn guide 125 is a yarn tensioning structure which includes tensioning bars **126*a*, 126*b* and 126*c* all carried on brackets such as bracket 127. These bars tension the yarns, prior to the time the yarns pass through the holes of the yarn guide 125. Mounted in the central portion of each plate 90 is a yarn guide 128. Certain of the yarns 20, which pass to the pair of longitudinally aligned rolls below shafts 46*a* and 46*b*, pass through the yarn guide 128. Thereafter, the yarns pass around the high speed rolls and up and over the low speed roller 109, passing through a yarn tunnel 130 and to the rolls 91*a* and 91*b*. These rolls 91*a* and 91*b* keep sufficient tension on the yarns that they do not readily slip off of the rolls 108 or 109**.

Yarns also pass around the outer rows 108 and 109 below the drive shafts **46*c* and 46*d* in the same manner as the yarns are passed around the rolls 108 and 109 of the shafts 46 and 46*b*. As pointed out above, it is not necessary to rethread the yarns in order to have access to a roll 108 or 109 since the rolls which are in longitudinal alignment are spaced from each other to permit intermediate portion of the yarns to be looped over the rollers 108 or 109** as the case may be.

It will be obvious to those skilled in the art that many variations may be made in the embodiment here chosen for the purpose of illustrating the present invention, without departing from the scope thereof as defined by the appended claims.

We claim:

1. A yarn feed mechanism for a tufting machine of the type having needles which are reciprocated for inserting loops of yarns through successive portions of a back material fed through the tufting machine, the needles receiving the yarns from a source of yarns adjacent to the tufting machine, the needles being reciprocated in synchronization with the rotation of a main shaft on the machine, said yarn feed mechanism comprising:

(a) a support frame disposed adjacent to said tufting machine;

(b) a plurality of first feed rolls transversely spaced from each other for rotation about a common first axis;

(c) a plurality of second yarn feed rolls transversly spaced from each other for rotation about a second common axis;

(d) a plurality of first roll shafts supported by said frame and transversely spaced from each other for rotation about said first common axis;

(e) a plurality of second roll shafts supported by said frame and transversely spaced from each other along said second common axis;

(f) means for driving said first shafts at one speed of rotation and said second shaft at a different speed of rotation;

(g) clutch means mounted on the end portion of each first shaft and on the end portion of each second shaft, said rolls being respectively received over said clutch means, whereby the clutch means of each roll will engage and rotate its associated roll from its shaft when the clutch is engaged, and will permit its associated roll to rotate freely when that clutch means disengages its associated roll;

(h) the space between a first roll on one first shaft and an adjacent first roll on the next adjacent first shaft being essentially unobstructed for permitting intermediate portions of yarns between the source of yarns and the needles to be passed partially around said first rolls without unthreading or breaking the yarns; and (i) the space between a second roll on one second shaft and an adjacent second roll on the next adjacent second shaft being essentially unobstructed for permitting the intermediate portion of yarns passed partially around the first roll to also be passed partially around the second roll to provide support for a yarn or yarns on both a first roll and a second roll.

2. The yarn feed mechanism defined in claim 1 wherein said frame includes a plurality of longitudinally extending transversely spaced plates extending below said frames for supporting pairs of said first and second drive shafts.

3. The yarn feed mechanism defined in claim 1 wherein said means for driving said first shaft at one speed of rotation and said second shaft at a different speed of rotation includes transversely extending drive shafts in said frame and driven by said main shaft, and means extending from said drive shafts to said first shafts and said second shafts for rotating the same at their speeds of rotation.

4. The yarn feed mechanism defined in claim 1 wherein said frame is disposed of horizontally and said rolls are disposed below said frame, and bracket means for supporting said frame from said tufting machine.

5. The yarn feed mechanism defined in claim 1 wherein said first roll shafts and said second roll shafts are rotated in synchronzation with each other and with the reciprocation of said needles.

6. The yarn feed mechanism defined in claim 1 wherein said means for driving said first shaft at one speed of rotation and said second shaft at a different speed of rotation includes a gear train from said main shaft to said roll shafts.

7. The yarn feed mechanism defined in claim 1 including additional rolls on the other ends of said roll shafts, the additional rolls being spaced from adjacent rolls on other of said roll shafts.

8. A yarn feed mechanism being supported by a tufting machine comprising a frame, means extending between said frame and between said tufting machine for supporting said tufting machine in a horizontal position, a high speed drive shaft journalled by said frame, a low speed drive shaft disposed parallel to said high speed drive shaft and supported for rotation by said frame, said low speed drive shaft and said high speed drive shaft being driven in synchronization with each other but at different speeds, a plurality of spaced roll shafts disposed below and parallel to said drive shafts, rolls on the end of said roll shafts, the rolls being spaced both transversely and longitudinally from each other, and clutches driven by said roll shafts and within said rolls, respectively, for engaging and disengaging said rolls, individually.

9. The yarn feed mechanism defined in claim 8 including means for supporting said frame in counterlever fashion from said tufting machine, said frame being supported in essentially a horizontal position.

10. The yarn feed mechanism defined in claim 8 wherein the spaces between adjacent rolls on the aligned shafts are essentially unobstructed.

* * * * *